US008348650B2

(12) United States Patent
Inagaki et al.

(10) Patent No.: US 8,348,650 B2
(45) Date of Patent: Jan. 8, 2013

(54) ROOT PUMP

(75) Inventors: Masahiro Inagaki, Kariya (JP); Shinya Yamamoto, Kariya (JP); Makoto Yoshikawa, Kariya (JP); Yuya Izawa, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 819 days.

(21) Appl. No.: 12/440,690

(22) PCT Filed: Jul. 17, 2008

(86) PCT No.: PCT/JP2008/062940

§ 371 (c)(1),
(2), (4) Date: Mar. 10, 2009

(87) PCT Pub. No.: WO2009/011395

PCT Pub. Date: Jan. 22, 2009

(65) Prior Publication Data

US 2009/0285711 A1 Nov. 19, 2009

(30) Foreign Application Priority Data

Jul. 19, 2007 (JP) ..... 2007-188312

(51) Int. Cl.
*F04C 18/00* (2006.01)
*F04C 2/00* (2006.01)

(52) U.S. Cl. ..... 418/206.7; 418/9; 418/104; 418/206.6; 277/303; 277/400; 277/430; 384/114; 384/118

(58) Field of Classification Search ..... 418/9, 88, 418/104, 141, 206.6, 206.8, 206.7, 206.1; 277/303, 306, 309, 399, 400, 423, 430; 384/114, 384/115, 118–120
See application file for complete search history.

(56) References Cited

U.S. PATENT DOCUMENTS

| | | | | | |
|---|---|---|---|---|---|
| 4,925,321 | A * | 5/1990 | Maruyama et al. | ..... | 384/114 |
| 4,948,347 | A * | 8/1990 | Fujiwara et al. | ..... | 418/220 |
| 4,990,069 | A * | 2/1991 | Guittet et al. | ..... | 418/9 |
| 5,338,167 | A * | 8/1994 | Berges | ..... | 418/104 |
| 6,659,227 | B2 * | 12/2003 | Yamamoto et al. | ..... | 277/303 |
| 6,659,747 | B2 * | 12/2003 | Yamamoto et al. | ..... | 418/104 |
| 6,663,367 | B2 * | 12/2003 | Yamamoto et al. | ..... | 418/104 |

FOREIGN PATENT DOCUMENTS

| | | | | |
|---|---|---|---|---|
| JP | 62-189388 | A | 8/1987 | |
| JP | 03242489 | A * | 10/1991 | ..... 418/104 |
| JP | 04-132895 | A | 5/1992 | |
| JP | 07-247975 | A | 9/1995 | |
| JP | 11-508343 | A | 7/1999 | |
| JP | 2001-304122 | A | 10/2001 | |
| JP | 2002257244 | A | 11/2002 | |
| JP | 2002327848 | A | 11/2002 | |
| JP | 2003307192 | A | 10/2003 | |

* cited by examiner

*Primary Examiner* — Theresa Trieu
(74) *Attorney, Agent, or Firm* — Woodcock Washburn LLP

(57) ABSTRACT

A housing of a Roots pump is configured by joining a lower housing member and an upper housing member that are separable from each other. With the upper and lower housing members joined together, an upper accommodating portion and a lower accommodating portion form a front bearing accommodating portion and a rear bearing accommodating portion, which accommodate whole bearings, respectively. The Roots pump further includes bearing holders attached to the bearings and fixed to the lower housing member so that the bearings are received in the lower accommodating portion in a positioned state.

5 Claims, 5 Drawing Sheets

ROOT PUMP

FIELD OF THE INVENTION

The present invention relates to a fluid machine that transports fluid by rotating a rotor through rotation of a rotary shaft.

BACKGROUND OF THE INVENTION

As one such fluid machine, a vacuum pump disclosed in Patent Document 1, for example, has been proposed. The vacuum pump of Patent Document 1 includes a housing formed by a rotor housing member, a front housing member, and a rear housing member. The front housing member is joined to a front end of the rotor housing member. The rear housing member is joined to a rear end of the rotor housing member. The rotor housing member is a cylinder block configured by a pair of upper and lower block pieces. A pair of rotary shafts are rotatably supported by the front housing member and the rear housing member each through a radial bearing. A plurality of rotors are fixed to each of the rotary shafts. The rotary shafts rotate synchronously through engagement between gears each secured to an end of the corresponding rotary shaft. Each of the radial bearings is supported by a bearing holder, and the bearing holder is fixedly fitted in an engagement hole formed in an end surface of the rear housing member.

The housing of the vacuum pump is assembled in the following manner. The rotary shafts are supported by a lower one of the block pieces, or a lower block piece. Then, an upper block piece is joined to the lower block piece to form the cylinder block. The front housing member and the rear housing member are then joined to the cylinder block. Subsequently, the bearing holders, to which the radial bearings are attached, are fitted in the engagement holes of the rear housing member along the axial directions of the rotary shafts, which are supported by the housing. The vacuum pump is thus completed. Specifically, prior to joining the upper block piece with the lower block piece, the clearances between the rotors and the inner surface of the cylinder block facing the rotors are adjusted. Before joining the upper block piece to the lower block piece, the engagement positions of the gears, which are secured to the ends of the respective rotary shafts, are adjusted so as to provide a proper phase difference between each engageable pair of the rotors of the two rotary shafts.

In the vacuum pump of Patent Document 1, if the clearances between the rotors and the inner surface of the cylinder block or the phase difference between each engageable pair of the rotors is not appropriate after the housing has been assembled, it is necessary to repeat the adjustment of the clearances or the phase difference. Such readjustment is performed as follows. The radial bearings and the bearing holders are removed from the rear housing member, and the front housing member and the rear housing member are separated from the cylinder block. The upper block piece is then removed from the lower block piece. As a result, the vacuum pump of Patent Document 1 requires complicated assembly of the housing and complicated readjustment after completion of the assembly of the housing.

Patent Document 2 proposes a fluid machine that simplifies assembly of a housing. The fluid machine of Patent Document 2 is a multistage vacuum pump having a casing (a housing) with a two-piece structure that can be divided into upper and lower pieces. The casing includes a plurality of pump operation chambers. The fluid machine is assembled simply by joining an upper casing member with a lower casing member after supporting a pair of rotary shafts, to which a plurality of rotors are fixed, by means of the lower casing member each through a bearing and a shaft sealing device. In the fluid machine of Patent Document 2, before the upper casing member is joined to the lower casing member, the clearances between the rotors and the inner surfaces of the pump operation chambers are adjusted. Further, engagement positions of timing gears, which are each secured to an end of the corresponding rotary shaft, are adjusted so as to ensure an appropriate phase difference between each engageable pair of the rotors between the two rotary shafts.

However, in assembly of the casing of the fluid machine of Patent Document 2, when the rotary shafts are supported by the lower casing member through the respective bearings, the bearings separate from the lower casing member. If the phase difference between each engageable pair of the rotors is adjusted with the bearings separated from the lower casing member, the phase difference cannot be set to an appropriate value. Further, if the upper casing member is joined to the lower casing member in this state, the fluid machine is assembled with the phase difference maintained as an inappropriate value.

Patent Document 1: Japanese Laid-Open Patent Publication No. 2002-257244

Patent Document 2: Japanese Laid-Open Patent Publication No. 4-132895

SUMMARY OF THE INVENTION

Accordingly, it is an objective of the present invention to provide a fluid machine that simplifies adjustment after assembly of a housing and prevents a bearing from separating from the housing when the housing is assembled.

To achieve the forgoing objective and in accordance with one aspect of the present invention, a fluid machine including a rotary shaft, a housing supporting the rotary shaft through a bearing, and a rotor rotatable integrally with the rotary shaft is provided. The fluid machine transports fluid through rotation of the rotor together with the rotary shaft. The housing is configured by joining a lower housing member and an upper housing member that are separable from each other. The lower housing member includes a lower accommodating portion that has an upward opening so as to receive a lower portion of the bearing. The upper housing member includes an upper accommodating portion that has a downward opening so as to accommodate an upper portion of the bearing. With the upper and lower housing members joined together, the upper and lower accommodating portions form a bearing accommodating portion that accommodates the entire bearing. The fluid machine includes a positioning member that is attached to the bearing and fixed to the lower housing member in such a manner that the bearing is accommodated in the lower accommodating portion in a positioned state.

DETAILED DESCRIPTION OF THE PREFERRED EMBODIMENTS

Figure 1:
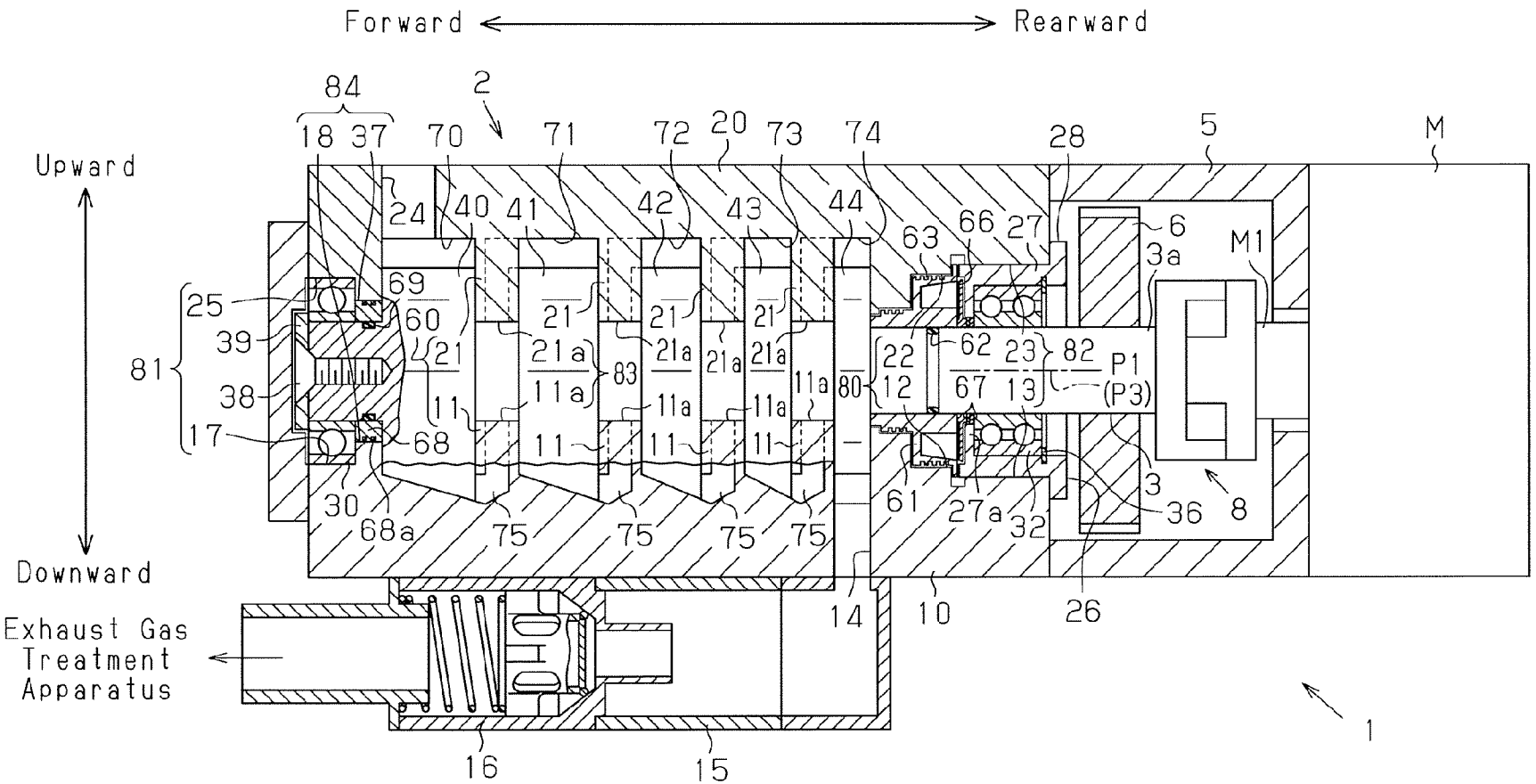
FIG. 1 is a cross-sectional side view showing a Roots pump according to a first embodiment of the present invention.

A first embodiment of a fluid machine according to the present invention, or a Roots pump 1, will now be described with reference to FIGS. 1 to 6. In the following description, an upper side of FIG. 1 corresponds to an upper side of the Roots pump 1, and a lower side of the drawing corresponds to a lower side of the Roots pump 1. Also, a left side of the drawing corresponds to a front side of the Roots pump 1, and a right side of the Roots pump 1 corresponds to a rear side of the Roots pump 1.

Figure 3:
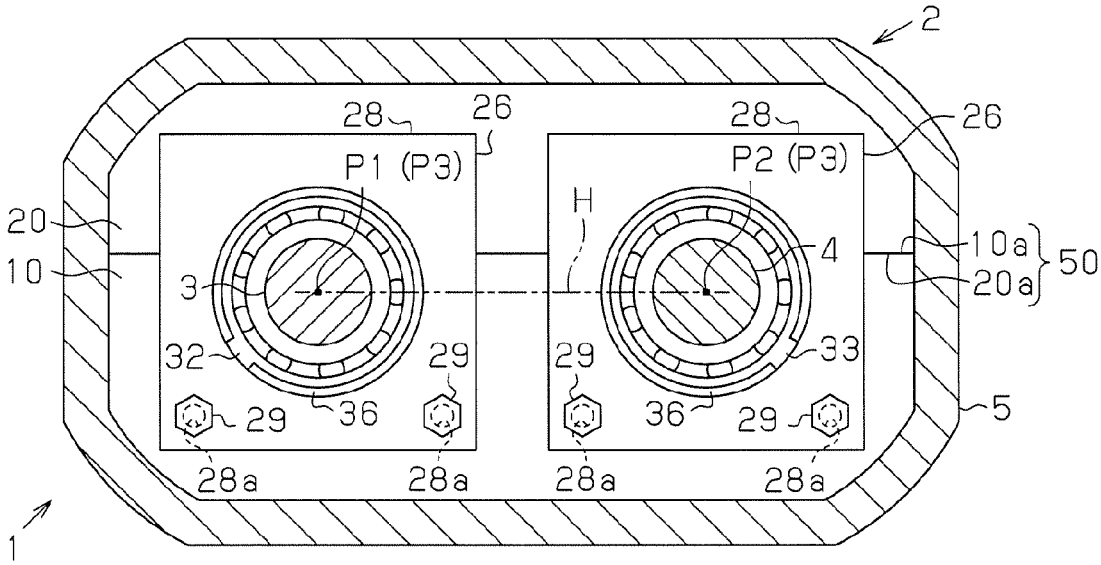
FIG. 3 is a cross-sectional view taken along line 3-3 of FIG. 2.

As shown in FIG. 1, a housing 2 of the Roots pump 1 has a lower housing member 10 and an upper housing member 20, which is joined to the lower housing member 10. In other words, the housing 2 has a two-piece structure that can be divided into an upper piece and a lower piece. As illustrated in FIG. 3, the upper surface of the lower housing member 10 forms a lower joint surface 10*a*, which is provided as a flat surface that contacts the upper housing member 20. The entire portion of the lower joint surface 10*a* is arranged on a common plane. In other words, the heights of all portions of the lower joint surface 10*a* are equal with respect to the lower surface of the lower housing member 10, or the lowermost portion of the lower housing member 10.

Similarly, the lower surface of the upper housing member 20 forms an upper joint surface 20*a*, which is provided as a flat surface that contacts the lower housing member 10. The entire portion of the upper joint surface 20*a* is located on a common plane. A joint portion between the upper joint surface 20*a* and the lower joint surface 10*a* configures a joint portion 50 of the housing 2. The term "two-piece structure" refers to the structure in which the lower housing member 10 is joined to the upper housing member 20 with the lower joint surface 10*a* of the lower housing member 10 fully contacts the upper joint surface 20*a* of the upper housing member 20 without forming any steps, as shown in FIG. 3.

As illustrated in FIG. 1, a plurality of lower wall pieces 11 are formed in the lower housing member 10, projecting toward the upper housing member 20. A plurality of upper wall pieces 21 are formed in the upper housing member 20, projecting toward the lower housing member 10. Each one of the lower wall pieces 11 forms a pair with a corresponding one of the upper wall pieces 21. Each pair of the lower wall piece 11 and the upper wall piece 21 forms an end wall 60. A pair of shaft accommodating portions 83, which are provided as holes, are formed in each of the end walls 60. The shaft accommodating portions 83 are aligned in the direction of the width of the Roots pump 1. One of the shaft accommodating portions 83 accommodates a drive shaft 3, and the other one of the shaft accommodating portions 83 accommodates a driven shaft 4.

Figure 2:
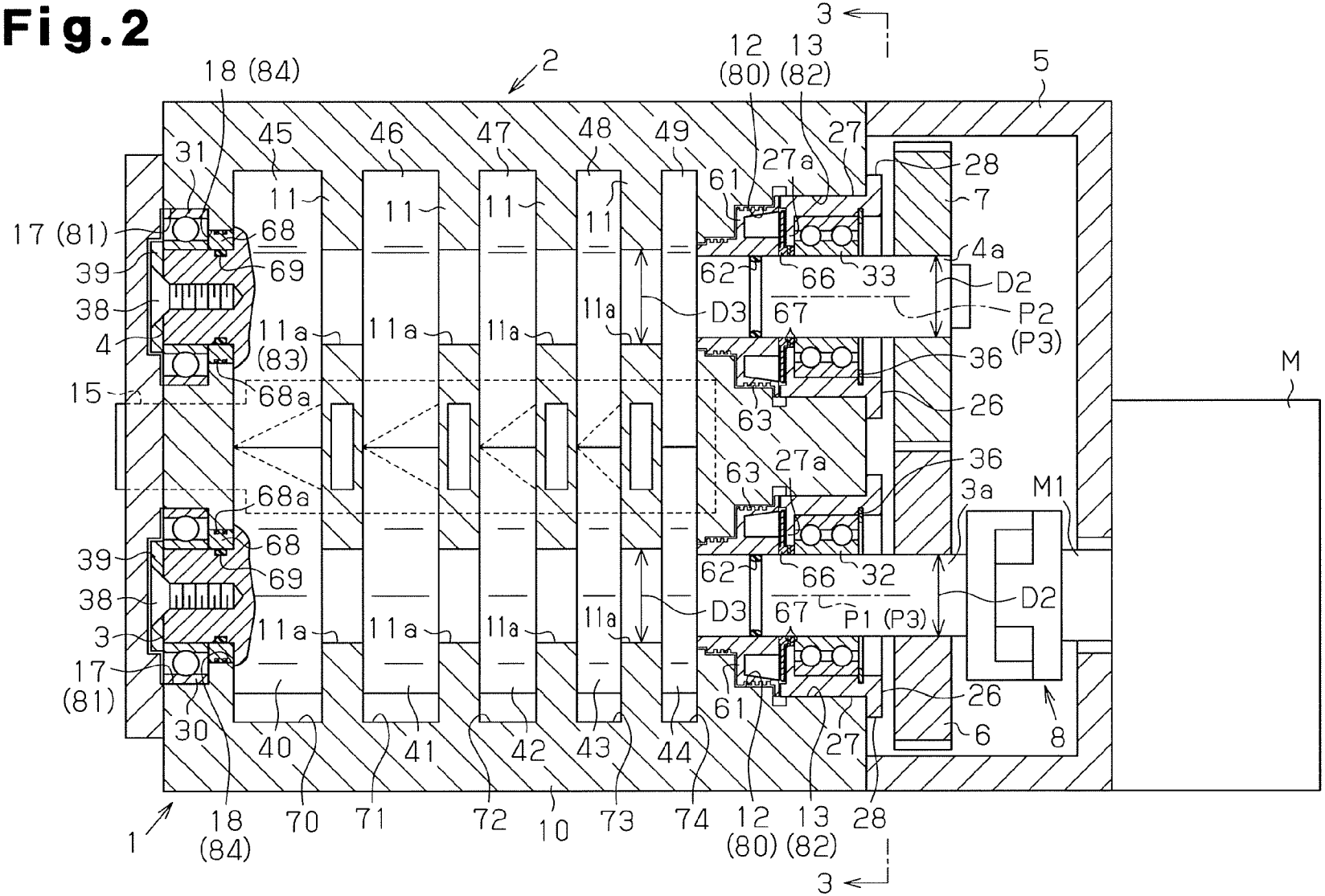
FIG. 2 is a cross-sectional plan view showing the Roots pump illustrated in FIG. 1.

A pair of rear seal accommodating portions 80, each of which is provided as a circular hole, are formed in a rear portion of the housing 2. The rear seal accommodating portions 80 are aligned in the direction of the width of the Roots pump 1. In the housing 2, rear bearing accommodating portions 82, each of which is formed as a circular hole, are arranged rearward from the rear seal accommodating portions 80 in a manner continuous from the rear seal accommodating portions 80. The rear seal accommodating portions 80 are aligned in the direction of the width of the Roots pump 1. With reference to FIG. 2, the rear bearing accommodating portions 82 each receive a bearing holder 26 serving as a bearing positioning member and a rear bearing 32, 33, which is a radial bearing.

With reference to FIG. 1, a pair of front bearing accommodating portions 81, each of which is provided as a circular hole, are formed in a front portion of the housing 2. The front bearing accommodating portions 81 are aligned in the direction of the width of the Roots pump 1. In the housing 2, a pair of front seal accommodating portions 84, each of which is provided as a circular hole, are arranged rearward from the front bearing accommodating portions 81. The front seal accommodating portions 84 are aligned in the direction of the width of the Roots pump 1. As illustrated in FIG. 2, each one of the front bearing accommodating portions 81 accommodates and supports a corresponding one of front bearings 30, 31, which are radial bearings. The inner ring of each one of the front bearings 30, 31 is positioned by a positioning plate 39, which is secured to the front end of the associated one of the shafts 3, 4 through a positioning bolt 38, in the direction of the axis P1, P2 of the shaft 3, 4. Hereinafter, the axis P1 of the drive shaft 3 will be referred to as the first axis P1, and the axis P2 of the driven shaft 4 will be referred to as the second axis P2.

As illustrated in FIG. 1, in the housing 2, the space between each adjacent pair of the end walls 60 defines a pump chamber 70, 71, 72, 73, 74. The foremost one of the pump chambers 70 to 74, or the pump chamber 70, communicates with a suction port 24 formed in an upper front portion of the upper housing member 20. The pump chamber 74, which is located rearmost, communicates with a discharge port 14, which is formed in a lower rear portion of the lower housing member 10. Each adjacent pair of the pump chambers 70 to 74 communicate with each other through a communication passage 75, which is formed in the corresponding one of the lower wall pieces 11.

The two shaft accommodating portions 83, which are formed in each of the end walls 60, each accommodate the corresponding one of the drive shaft 3 and the driven shaft 4. The drive shaft 3 and the driven shaft 4 are arranged parallel with each other and extend in the forward and rearward direction of the Roots pump 1. With reference to FIG. 2, the drive shaft 3 is rotatably supported by the housing 2 through the rear bearing 32 received in the associated rear bearing accommodating portion 82 and the front bearing 30 accommodated in the associated front bearing accommodating portion 81. The driven shaft 4 is rotatably supported by the housing 2 through the rear bearing 33 received in the associated rear bearing accommodating portion 82 and the front bearing 31 accommodated in the associated front bearing accommodating portion 81.

FIG. 3 illustrates an imaginary plane H including the first axis P1 of the drive shaft 3 and the second axis P2 of the driven shaft 4, which are arranged in parallel. The portion located above the imaginary plane H is defined as the upper side of the Roots pump 1 and the portion below the imaginary plane H is defined as the lower side of the Roots pump 1. Further, the direction proceeding from one of the drive shaft 3 and the driven shaft 4 to the other is defined as "the direction of the width of the Roots pump 1". In other words, "the direction of the width of the Roots pump 1" extends along the imaginary plane H and corresponds to the left and right direction of FIG.

3. That is, "the direction of the width of the Roots pump 1" refers to the direction in which the drive shaft 3 and the driven shaft 4 are arranged in parallel.

As illustrated in FIG. 2, a plurality of (five) drive rotors 40, 41, 42, 43, 44 are arranged on the drive shaft 3 in a manner rotatable integrally with one another. A plurality of driven rotors 45, 46, 47, 48, 49, which are provided by the number equal to the number of the drive rotors 40 to 44, are arranged on the driven shaft 4 in a manner rotatable integrally with one another. As viewed in the directions of the axes P1, P2, all of the rotors 40 to 49 are shaped identically and sized equally. As indicated by the broken lines in FIG. 6, a cross section of each of the rotors 40 to 49 perpendicular to the corresponding axis P1, P2 has a two-lobe shape, or a gourd-like shape. In other words, each rotor 40 to 49 has a pair of lobes and recesses between the lobes. The drive rotors 40 to 44 and the driven rotors 45 to 49 are arranged in such a manner that the thicknesses of the rotors 40 to 44 and 45 to 49 become smaller successively from the front to the rear.

With reference to FIG. 2, the drive rotor 40 and the driven rotor 45 are received in the pump chamber 70 with a predetermined phase difference and in a mutually engageable state. In a manner similar to the case of the rotors 40 and 45, the rotors 41 and 46, the rotors 42 and 47, the rotors 43, 48, and the rotors 44, 49 are accommodated in the pump chamber 71, the pump chamber 72, the pump chamber 73, and the pump chamber 74, respectively. Each one of the rotors 40 to 49 rotates while being spaced from the corresponding one of the end walls 60, which defines the pump chambers 70 to 74, by a small gap (a clearance).

A gear housing 5 is joined to the rear end of the housing 2. An end 3*a* of the drive shaft 3 and an end 4*a* of the driven shaft 4 project into the gear housing 5. A drive gear 6 is secured to the end 3*a* of the drive shaft 3 and a driven gear 7 is secured to the end 4*a* of the driven shaft 4. The drive gear 6 and the driven gear 7 are engaged with each other and thus form a gear mechanism. The drive gear 6 and the driven gear 7 are timing gears by which timings are regulated so as to maintain a predetermined phase difference between each one of the drive rotors 40 to 44 and the corresponding one of the driven rotors 45 to 49.

An electric motor M is assembled to the gear housing 5. A drive shaft M1 projecting from the electric motor M is connected to the drive shaft 3 through a shaft joint 8. As the electric motor M drives the drive shaft 3, the driven shaft 4 rotates synchronously with the drive shaft 3. This rotates the rotors 40 to 49 so that the fluid (the gas) in the pump chambers 70 to 74 is sent in a pressurized state to an exhaust gas treatment apparatus through the discharge port 14, a connection muffler 15, and a discharge mechanism 16.

Figure 6:
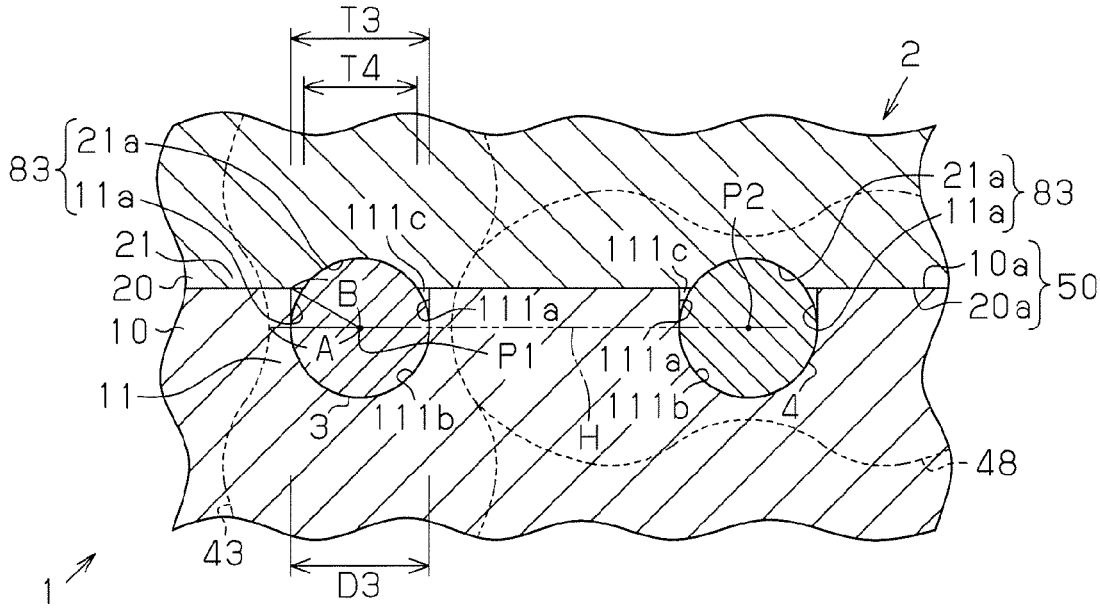
FIG. 6 is a cross-sectional view showing a portion corresponding to a shaft accommodating portion.

Next, the shaft accommodating portions 83 will be described. FIG. 6 is a cross-sectional view showing the Roots pump 1, perpendicular to the first axis P1 of the drive shaft 3 and the second axis P2 of the driven shaft 4. With reference to FIG. 6, each shaft accommodating portion 83 is formed as a hole by combining a lower accommodating portion 11*a* formed in the lower wall piece 11 in a recessed manner and an upper accommodating portion 21*a* formed in the upper wall piece 21 in an arcuately recessed manner. When the drive shaft 3 and the driven shaft 4 are accommodated in the corresponding shaft accommodating portions 83, a space is provided between the circumferential surface of each shaft 3, 4 and the inner circumferential surface of the corresponding shaft accommodating portion 83.

The portion of each lower accommodating portion 11*a* located below the axis P1, P2 of the corresponding shaft 3, 4, which is received in the lower accommodating portion 11*a*, forms a semi-circular shape extending along the circumferential surface of the shaft 3, 4. The portion of the lower accommodating portion 11*a* located above the axis P1, P2 of the shaft 3, 4 extends linearly in the vertical direction. In other words, each lower accommodating portion 11*a* includes a pair of straight portions 111*a* and a semi-circular portion 111*b*. The semi-circular portion 111*b* is the portion of the lower accommodating portion 11*a* below the axis P1, P2 and accommodates the portion of the shaft 3, 4 located below the axis P1, P2. Each one of the two straight portions 111*a* is a portion of the lower accommodating portion 11*a* located above the axis P1, P2 and extends continuously from the semi-circular portion 111*b* and perpendicularly to the lower joint surface 10*a*.

Accordingly, the straight portions 111*a* of each lower accommodating portion 11*a* face each other in the direction of the width of the Roots pump 1 and defines a shaft insertion space, or a shaft inserting portion 111*c*, between each other. This allows each shaft 3, 4 to be inserted into the corresponding shaft inserting portion 111*c* from above. The width between the straight portions 111*a*, or the opening width T3 of each lower accommodating portion 11*a*, is set to a value slightly greater than the diameter D3 of the corresponding shaft 3, 4.

The upper accommodating portion 21*a* has an arcuate shape extending along the circumferential surface of the portion of the corresponding shaft 3, 4 protruding above the lower joint surface 10*a*. The opening width T4 of the upper accommodating portion 21*a* is set to a value smaller than the diameter D3 of the shaft 3, 4.

The distance from the axis P1, P2 of each shaft 3, 4 to the portion (the bottom of the recessed portion) of the corresponding rotor 40 to 49 that has a minimum thickness with respect to the axis P1, P2 will be referred to as the distance A. The distance from the axis P1, P2 of the shaft 3, 4, which is accommodated in the corresponding lower accommodating portion 11*a*, to the opening end of the lower accommodating portion 11*a*, or the boundary between the straight portions 111*a* and the lower joint surface 10*a*, will be referred to as the distance B. In this case, the distance A is greater than the distance B. As a result, the gap between each straight portion 111*a* and the circumferential surface of the corresponding shaft 3, 4 is located radially inside of the bottom of the recessed portion of the rotor 40 to 49. The gap is thus constantly closed by those of the rotors that are located at both axial sides of the gap.

Figure 4:
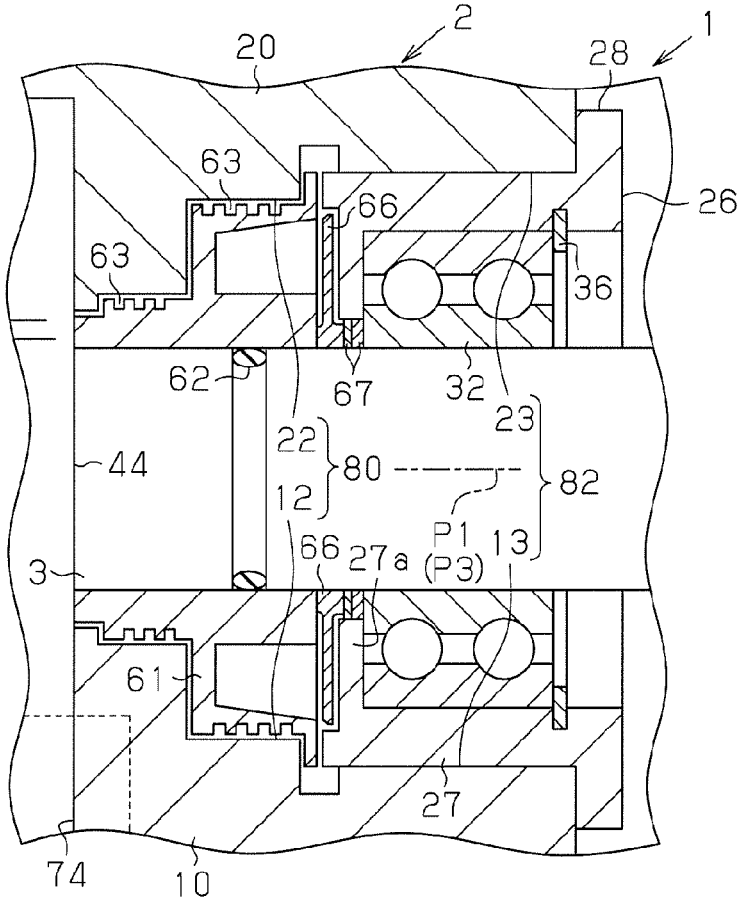
FIG. 4 is an enlarged cross-sectional view showing a portion in the vicinity of a rear seal accommodating portion and a rear bearing accommodating portion.

The rear seal accommodating portions 80 will hereafter be described. As illustrated in FIG. 4, each rear seal accommodating portion 80 is formed as a circular hole by combining a lower accommodating portion 12, which is formed in the lower housing member 10 in an arcuately recessed manner, and an upper accommodating portion 22, which is provided in the upper housing member 20 in an arcuately recessed manner. Each rear seal accommodating portion 80 has a stepped shape with a diameter becoming smaller from the rear to the front along the axis P1, P2. The rear seal accommodating portion 80 receives an annular shaft seal 61, which is secured to the associated shaft 3, 4.

Although not illustrated, the uppermost portion, or the opening end, of each lower accommodating portion 12 is located above the axis of the annular shaft seal 61, which is accommodated in the lower accommodating portion 12. The portion of the lower accommodating portion 12 located above the axis of the annular shaft seal 61 is formed along the outer circumferential surface of the annular shaft seal 61. In other words, the portion of the lower accommodating portion 12 located above the axis of the annular shaft seal 61 protrudes toward the annular shaft seal 61. The upper end of the lower accommodating portion 12 reaches the lower joint surface 10*a*, which is located above the imaginary plane H. The upper accommodating portion 22 has an arcuate shape extending along the circumferential surface of the portion of the annular shaft seal 61 protruding above the lower joint surface 10*a*.

A sealing ring 62 is arranged between the inner circumferential surface of each one of the annular shaft seals 61 and the circumferential surface of the corresponding one of the shafts 3, 4. Each of the sealing rings 62 prevents the fluid in the pump chambers 70 to 74 from leaking to the exterior of the Roots pump 1 along the circumferential surface of the corresponding one of the shafts 3, 4. A space is formed between the outer circumferential surface of each annular shaft seal 61 and the circumferential surface of the corresponding rear seal accommodating portion 80. Each annular shaft seal 61 is rotatable integrally with the corresponding shaft 3, 4.

A spiral groove 63 is formed in the outer circumferential surface of each annular shaft seal 61. The spiral groove 63 is formed in such a manner that the corresponding shaft 3, 4 moves from the gear housing 5 toward the pump chamber 74 as the shaft 3, 4 is guided by the spiral groove 63 in the same direction as the rotational direction of the shaft 3, 4. The spiral groove 63 forms a pumping portion that urges the lubricant oil between the outer circumferential surface of the corresponding annular shaft seal 61 and the circumferential surface of the associated rear seal accommodating portion 80 to move from the pump chamber 74 toward the gear housing 5.

In each rear seal accommodating portion 80, an annular slinger 66 is fixedly engaged with the outer circumference of the corresponding shaft 3, 4. The outer diameter of the portion of each of the slingers 66 with the maximum diameter is greater than the outer diameter of each rear bearing 32, 33. The lubricant oil collected on the outer surface of each slinger 66 is splashed in a radially outward direction of the slinger 66 by centrifugal force produced through rotation of the slinger 66.

The rear bearing accommodating portions 82 will hereafter be explained. As illustrated in FIG. 4, each of the rear bearing accommodating portions 82 is formed as a circular hole by combining a lower support portion 13, which is formed in the lower housing member 10 in an arcuately recessed manner, and an upper support portion 23, which is provided in the upper housing member 20 in an arcuately recessed manner. Each rear bearing accommodating portion 82 accommodates the corresponding bearing holder 26. FIG. 4 is a cross-sectional view showing the rear seal accommodating portion 80 and the rear bearing accommodating portion 82 corresponding to the drive shaft 3. The rear seal accommodating portion 80 and the rear bearing accommodating portion 82 corresponding to the driven shaft 4 are not illustrated in the drawing since the portions are identical with those corresponding to the drive shaft 3.

With reference to FIG. 4, each bearing holder 26 is formed of the same metal material (which is, for example, steel) as the lower housing member 10. In this manner, the thermal expansion rate of the bearing holder 26 is equal to the thermal expansion rate of the lower housing member 10. As a result, if the lower housing member 10 and the bearing holder 26 thermally expand, the performance of the corresponding rear bearing 32, 33 is prevented from decreasing. Each bearing holder 26 has a cylindrical holder body 27 and a flange portion 28, which are provided as an integral body. The flange portion 28 projects radially outward from the entire outer circumference of the rear end of the holder body 27.

A restricting portion 27*a* is arranged on the inner circumferential surface of the front end of each of the holder bodies 27, projecting in a radially inward direction of the holder body 27. The restricting portion 27*a* projects perpendicularly to the axis P3 of the bearing holder 26. The inner diameter of the restricting portion 27*a* is greater than the diameter of each shaft 3, 4 and smaller than the outer diameter of each rear bearing 32, 33. The inner diameter of the portion of the holder body 27 other than the restricting portion 27*a* is slightly greater than the outer diameter of the rear bearing 32, 33.

This makes it possible to arrange each bearing holder 26 around the corresponding shaft 3, 4 and receive the corresponding rear bearing 32, 33 in the holder body 27. When the rear bearing 32, 33 is arranged in the holder body 27, the rear bearing 32, 33 is provided as an integral body with the holder body 27 so that the rear bearing 32, 33 does not separate from each axial side of the holder body 27. Specifically, contact between the rear bearing 32, 33 and the restricting portion 27*a* prevents the rear bearing 32, 33 from moving forward in the holder body 27. A snap ring 36 is secured to the inner circumferential surface of the holder body 27. The snap ring 36 contacts the rear end surface of the rear bearing 32, 33 held in the holder body 27. Each of the snap rings 36 thus prevents the corresponding one of the rear bearings 32, 33 from moving rearward in the associated one of the holder bodies 27.

Figure 5:
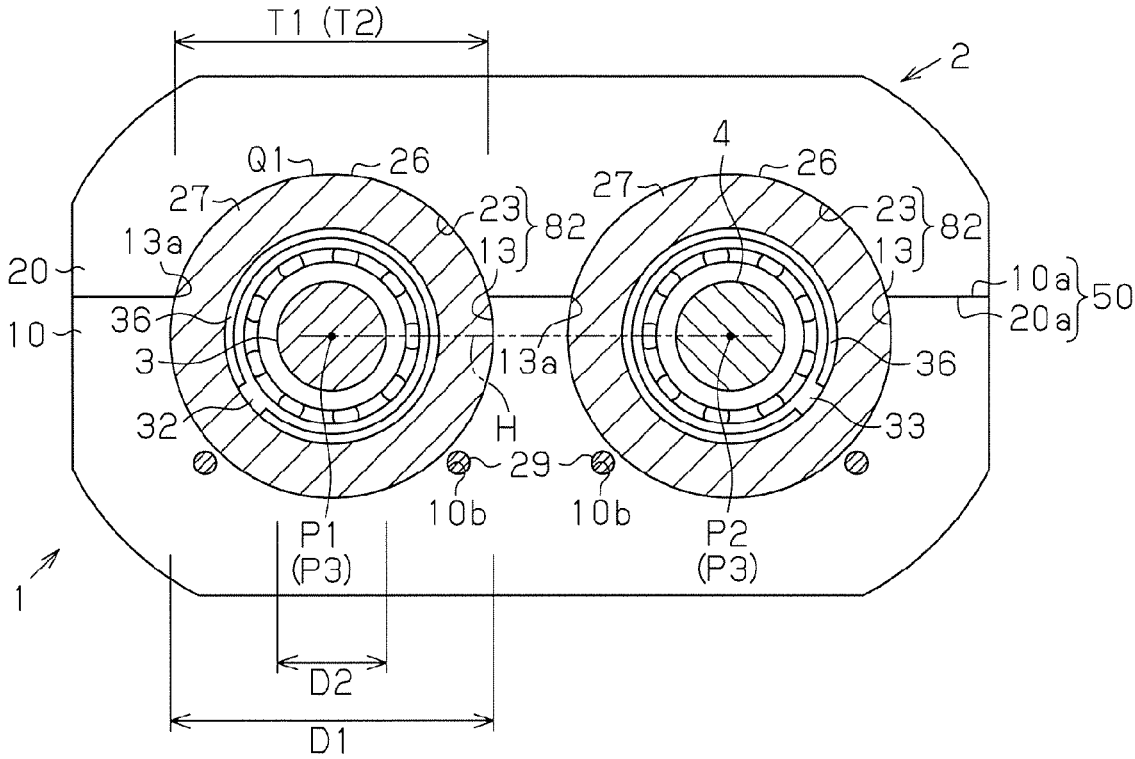
FIG. 5 is a cross-sectional view showing the rear bearing accommodating portion illustrated in FIG. 4.

With reference to FIG. 3, each of the flange portions 28 is formed as a rectangular plate. Each flange portion 28 has two through holes 28*a*. A bolt 29, or a fixing member that fixes the corresponding bearing holder 26 to the lower housing member 10, is passed through each of the through holes 28*a*. As illustrated in FIG. 5, threaded holes 10*b* are provided at the rear end of the lower housing member 10. The bolts 29, which are passed through the through holes 28*a*, are threaded to the corresponding threaded holes 10*b*. Specifically, the rear bearings 32, 33 are received in the bearing holders 26 and the bearing holders 26 are fixed to the lower housing member 10. The rear bearings 32, 33 are thus positioned with respect to and thus fixed to the lower housing member 10. Such positioning of the rear bearings 32, 33 using the bearing holders 26 is carried out without involving the upper housing member 20.

As illustrated in FIG. 5, each bearing holder 26 holding the associated rear bearing 32, 33 is received in the corresponding rear bearing accommodating portion 82. When the rear bearing 32, 33 supports the corresponding shaft 3, 4, the axis P3 of the associated bearing holder 26 and the axis P1, P2 of the shaft 3, 4 are arranged coaxially. Further, with the bearing holders 26 accommodated in the rear bearing accommodating portions 82, the joint portion 50 of the housing 2 is located above the axes P3 of the bearing holders 26 and the axes P1, P2 of the shafts 3, 4 and the height of the joint portion 50 is uniform throughout the entire portion of the joint portion 50. Specifically, the joint portion 50 is located at the center between the axes P3 of the bearing holders 26 and the top portions Q1 of the bearing holders 26.

The opening width T1 of each lower support portion 13 in the direction of the width of the Roots pump 1 is smaller than the outer diameter D1 of each bearing holder 26. The opening width T1 is greater than the diameter D2 of each shaft 3, 4 supported by the corresponding rear bearing 32, 33. The diameter D2 of the shaft 3, 4 is smaller than the diameter D3 of the portion of the shaft 3, 4 accommodated in the lower accommodating portion 11*a*. The holder body 27 of each bearing holder 26 is inserted into the lower support portion 13 along the extending direction of the axis P1, P2.

The opening end 13*a*, or the uppermost portion, of each lower support portion 13 is located above the axis P3 of the bearing holder 26 received in the lower support portion 13. The portion of the lower support portion 13 located above the axis P3 of the bearing holder 26 extends along the outer circumferential surface of the holder body 27. In other words, the portion of each lower support portion 13 located above the axis P3 of the associated bearing holder 26 protrudes toward the holder body 27. The upper end of the lower support portion 13 extends to the lower joint surface 10*a*, which is located above the imaginary plane H.

The opening width T2 of each upper support portion 23 in the direction of the width of the Roots pump 1 is smaller than the outer diameter D1 of each bearing holder 26 and greater than the diameter D2 of the portion of each shaft 3, 4 supported by the corresponding rear bearing 32, 33. The opening width T2 of the upper support portion 23 is equal to the opening width T1 of each lower support portion 13. The upper support portion 23 is formed in an arcuate shape that extends along the circumferential surface of the portion of the holder body 27 protruding above the lower joint surface 10*a*. As illustrated in FIG. 4, an annular shim 67 is attached to the portion of each shaft 3, 4 arranged in the corresponding rear bearing accommodating portion 82.

Next, the front bearing accommodating portions 81 will be explained. As illustrated in FIGS. 1 and 2, each front bearing accommodating portion 81 is formed as a circular hole by combining a lower support portion 17 formed in the lower housing member 10 in an arcuately recessed manner and an upper support portion 25 provided in the upper housing member 20 in an arcuately recessed manner. The opening end of each of the front lower support portions 17 in the direction of the width of the Roots pump 1 is smaller than the outer diameter of each front bearing 30, 31 and greater than the diameter of the portion of the shaft 3, 4 supported by the corresponding front bearing 30, 31. The opening end of each of the front lower support portions 17 is located above the axis of the front bearing 30, 31 received in the front lower support portion 17. In other words, the portion of the front lower support portion 17 located above the axis (not shown) of the front bearing 30, 31 is formed along the outer circumferential surface of the front bearing 30, 31.

The portion of each front lower support portion 17 located above the axis of the corresponding front bearing 30, 31 protrudes toward the front bearing 30, 31. The upper end of the front lower support portion 17 extends to the lower joint surface 10*a*, which is located above the imaginary plane H. The opening width of each front upper support portion 25 in the direction of the width of the Roots pump 1 is smaller than the outer diameter of each front bearing 30, 31 and greater than the diameter of the portion of the shaft 3, 4 supported by the front bearing 30, 31. The opening width of each front lower support portion 17 is equal to the opening width of each front upper support portion 25. The front upper support portion 25 is formed in an arcuate shape extending along the circumferential surface of the corresponding front bearing 30, 31 that protrudes above the lower joint surface 10*a*.

The front seal accommodating portions 84 will hereafter be described. Each of the front seal accommodating portions 84 is formed by combining a lower accommodating portion 18 formed in the lower housing member 10 in an arcuately recessed manner and an upper accommodating portion 37 formed in the upper housing member 20 in an arcuately recessed manner. The front seal accommodating portion 84 is shaped as a circular hole with a diameter smaller than the diameter of each front bearing accommodating portion 81. Each front seal accommodating portion 84 receives an annular shaft seal 68 fixed to the corresponding shaft 3, 4. Each of the annular shaft seals 68 is elastic and formed of, for example, synthetic resin.

A sealing ring 69 is provided between the inner circumferential surface of each annular shaft seal 68 and the circumferential surface of the corresponding shaft 3, 4. The sealing rings 69 each prevent the fluid in the pump chamber 70 from leaking to the exterior of the Roots pump 1 along the circumferential surface of the shaft 3, 4. A space is formed between the outer circumferential surface of the annular shaft seal 68 and the inner circumferential surface of the corresponding front seal accommodating portion 84. Each annular shaft seal 68 is rotatable integrally with the corresponding shaft 3, 4. A sealing ring 68*a* is arranged on the outer circumferential surface of each annular shaft seal 68.

Although not illustrated, the opening end, or the uppermost portion, of each front lower seal accommodating portion 18 is located above the axis of the annular shaft seal 68 accommodated in the front lower seal accommodating portion 18. The portion of the front lower seal accommodating portion 18 above the axis of the annular shaft seal 68 is formed along the outer circumferential surface of the annular shaft seal 68. In other words, the portion of the front lower seal accommodating portion 18 located above the axis of the annular shaft seal 68 protrudes toward the annular shaft seal 68. The upper end of the front lower seal accommodating portion 18 extends to the lower joint surface 10*a*, which is located above the imaginary plane H. Each front upper seal accommodating portion 37 is formed in an arcuate shape extending along the circumferential surface of the portion of the corresponding annular shaft seal 68 protruding above the lower joint surface 10*a*.

A method for assembling the Roots pump 1 will now be explained.

First, the lower housing member 10 is prepared. The shafts 3, 4 are moved toward the lower housing member 10 from above in such a manner that the rotors 40 to 49 are arranged between the corresponding adjacent pairs of the lower wall pieces 11 of the lower housing member 10. The shafts 3, 4 are then received in the corresponding lower accommodating portions 11*a* through the shaft inserting portions 111*c*. Subsequently, the annular shaft seals 68 are arranged in the corresponding front lower seal accommodating portions 18 along the axes P1, P2 of the shafts 3, 4 and then fixed to the shafts 3, 4. Next, the front bearings 30, 31 are received in the corresponding front lower support portions 17 along the axes P1, P2 of the shafts 3, 4 and then fixed to the shafts 3, 4. Then, the positioning plates 39 are fixed to the corresponding shafts 3, 4 using the positioning bolts 38 so that the front bearings 30, 31 are positioned.

Subsequently, the annular shaft seals 61, the slingers 66, and the shims 67 are attached to the corresponding shafts 3, 4 received in the rear lower seal accommodating portions 12 along the axes P1, P2. The thickness and the number of the shims 67 are set in advance in such a manner that the clearance between each rotor 40 to 49 and the corresponding lower wall piece 11 becomes a predetermined size.

Next, the rear bearings 32, 33 are received in the corresponding bearing holders 26, and the snap rings 36 are arranged at predetermined positions in the holder bodies 27. Each one of the bearing holders 26 and the corresponding one of the rear bearings 32, 33 are thus provided as an integral body. The distal end of the holder body 27 of each bearing holder 26 is inserted into the corresponding lower support portion 13 from behind the lower housing member 10. The rear bearing 32 and the rear bearing 33 are then fixed to the drive shaft 3 and the driven shaft 4, respectively. Further, the flange portions 28 are brought into contact with the rear end surface of the lower housing member 10, and the bolts 29 are threaded into the threaded holes 10*b* of the lower housing member 10 through the through holes 28*a* of the flange portions 28. This fixes the bearing holders 26 to the lower housing member 10. As a result, the bearing holders 26 are fixed to the lower housing member 10 so that the rear bearings 32, 33 are fixed to the lower housing member 10.

In this state, the front end surface of each rear bearing 32, 33 contacts the corresponding shim 67 and the rear end surface of the rear bearing 32, 33 contacts the corresponding snap ring 36. This restricts movement of each bearing 32, 33 along the axis P1, P2 and supports the rear bearing 32, 33 by the corresponding lower support portion 13 through the associated bearing holder 26. With the rear bearings 32, 33 supported by the corresponding lower support portions 13 through the bearing holders 26, the shafts 3, 4 supported by the rear bearings 32, 33 are prevented from separating from the lower support portions 13.

Subsequently, the clearance between each rotor 40 to 49 and the corresponding lower wall piece 11 is measured. For such measurement, one rotor is selected from the drive rotors 40 to 44 and another rotor is selected from the driven rotors 45 to 49. The clearance between each of the selected rotors and the corresponding one of the lower wall pieces 11 is measured using a clearance gauge and then adjusted. The drive rotors 40 to 44 are formed integrally with the drive shaft 3, and the driven rotors 45 to 49 are provided integrally with the driven shaft 4. Accordingly, as long as the clearances between the selected rotors and the corresponding lower wall pieces 11 are adjusted to appropriate values, the clearances between the other rotors and the corresponding lower wall pieces 11 are also set to the appropriate values simultaneously.

Once the measurements of the clearances become appropriate values, the adjustment of the clearances is ended. If the appropriate measurements of the clearances cannot be obtained, the bolts 29 are disengaged from the threaded holes 10*b*, and the rear bearings 32, 33 are removed from the lower support portions 13 together with the bearing holders 26. Then, the thickness or the number of the shims 67 is adjusted in such a manner as to ensure an appropriate clearance. Subsequently, the bearing holders 26, in which the rear bearings 32, 33, are arranged are fixed to the lower housing member 10. Since the annular shaft seals 68, which are provided in the front portion of the housing 2, are elastic, the annular shaft seals 68 elastically deform to permit movement of the shafts 3, 4 along the axes p1, P2 after the thickness or the number of the shims 67 has been changed. This enables adjustment of the clearances. Afterwards, the clearances are measured in the same manner as the above-described manner. The adjustment of the clearances is ended once the appropriate clearances are obtained.

Next, a pair of drive rotor and a driven rotor that are engaged with each other are selected from the drive rotors 40 to 44 and the driven rotors 45 to 49. The selected pair of rotors are then rotated so that the phase difference between the rotors is adjusted to a desired value. The drive rotors 40 to 44 are formed integrally with the drive shaft 3 and the driven rotors 45 to 49 are provided integrally with the driven shaft 4. Accordingly, as long as a desirable phase difference is obtained between the selected rotors, the phase differences between the other pairs of rotors are also adjusted simultaneously. Then, the drive gear 6 is secured to the end 3*a* of the drive shaft 3 and the driven gear 7 is secured to the end 4*a* of the driven shaft 4 in such a manner that the drive gear 6 becomes engaged with the driven gear 7.

When the drive gear 6 and the driven gear 7 are secured to the end 3*a* and the end 4*a*, respectively, upward force may be applied to the front bearings 30, 31 and the rear bearings 32, 33. However, the front lower support portions 17 prevent the front bearings 30, 31 from being lifted in the front portion of the housing 2, and the bearing holders 26 prevent the rear bearings 32, 33 from being lifted in the rear portion of the housing 2. This structure prevents the bearings 30 to 33 from moving away from the lower housing member 10.

After the drive gear 6 and the driven gear 7 are secured to the corresponding ends 3*a*, 4*a*, the upper housing member 20 is joined to the lower housing member 10. Then, the end 3*a* of the drive shaft 3 projecting from the drive gear 6 and the drive shaft Ml of the electric motor M are connected together through the shaft joint 8. As a result, assembly of the Roots pump 1 is complete.

If the appropriate clearances cannot be obtained between the rotors 40 to 49 and the lower wall pieces 11 or the appropriate phase differences cannot be provided between the engaged pairs of the rotors 40 to 49 after the Roots pump 1 has been assembled, adjustment of the clearances or the phase differences have to be repeatedly carried out. Readjustment of the phase differences is performed after the upper housing member 20 is separated from the lower housing member 10. Readjustment of the clearances is carried out after the upper housing member 20 is removed from the lower housing member 10, and then the bearing holders 26 and the rear bearings 32, 33 are removed.

The present embodiment has the following advantages.

(1) The housing 2 is assembled simply by joining the lower housing member 10 and the upper housing member 20 together. As a result, if the clearances between the rotors 40 to 49 and the lower wall pieces 11 or the phase differences between the engaged pairs of the rotors 40 to 49 need to be adjusted after the housing 2 is assembled, such adjustment can be carried out simply by separating the upper housing member 20 from the lower housing member 10. After the adjustment, the housing 2 is reassembled simply by joining the upper housing member 20 to the lower housing member 10. As a result, the Roots pump 1 of the illustrated embodiment facilitates the adjustment after completion of the assembly of the housing 2.

(2) The rear bearings 32, 33 are received in the corresponding bearing holders 26 fixed to the lower housing member 10. The bearing holders 26 thus prevent the rear bearings 32, 33 from separating from the lower support portions 13. This prevents the upper housing member 20 with the lower housing member 10 from being joined together while the rear bearings 32, 33 are separated from the lower support portions 13. As a result, adjustment of the phase differences between the engaged pairs of the rotors 40 to 49 with the rear bearings 32, 33 held in the separating states is prevented. In other words, the upper housing member 20 is prevented from being assembled to the lower housing member 10 while the phase differences between the engaged pairs of the rotors 40 to 49 are undesirable values. Further, since the bearing holders 26 prevent separating of the rear bearings 32, 33 after the housing 2 is assembled by joining the upper housing member 20 with the lower housing member 10, the clearances or the phase differences that have been adjusted are prevented from becoming undesirable values and maintained as the appropriate values.

(3) The uppermost portion of each lower support portion 13 is located above the axis P3 of the bearing holder 26 received in the lower support portion 13. Further, the opening width T1 of the lower support portion 13 is set to a value smaller than the outer diameter D1 of each bearing holder 26. As a result, when the bearing holders 26 are arranged in the lower support portions 13, the bearing holders 26 are prevented from separating from the lower support portions 13. This prevents the bearing holders 26 from being fixed to the lower housing member 10 while being separated from the lower support portions 13. Also, the rear bearings 32, 33 received in the bearing holders 26 are prevented from being attached while being separated from the lower support portions 13. Further, the opening width T1 of each lower support portion 13 in the direction of the width of the Roots pump 1 is set to a value greater than the diameter D2 of the portion of each shaft 3, 4 supported by the corresponding rear bearing 32, 33. The shafts 3, 4 thus can be inserted into the lower support portions 13 from above the lower housing member 10.

(4) The opening width of each front lower support portion 17 in the direction of the width of the Roots pump 1 is set to a value smaller than the outer diameter of the portion of the front bearing 30, 31 supported by the front lower support portion 17 and greater than the diameter of the portion of the shaft 3, 4 supported by the front bearing 30, 31. By setting the opening width of the front lower support portion 17 in this manner, the front bearings 30, 31 are prevented from separating from the lower housing member 10 and the shafts 3, 4 are allowed to be inserted into the front lower support portions 17 from above the lower housing member 10.

(5) The Roots pump 1 has the drive shaft 3 and the driven shaft 4. The drive shaft 3 and the driven shaft 4 are rotated synchronously through the gear mechanism. In this structure, the rear bearings 32, 33 may easily be lifted when the drive gear 6 and the driven gear 7 are engaged with each other. However, the bearing holders 26 fixed to the lower housing member 10 prevent such lifting of the rear bearings 32, 33. As a result, the configuration including the bearing holders 26 is effective particularly for use in the Roots pump 1, which has a plurality of rotary shafts.

(6) Each lower accommodating portion 11*a* has a pair of straight portions 111*a*, which are located in the upper portion of the lower accommodating portion 11*a*. The straight portions 111*a* forms the shaft inserting portion 111*c* that has the opening width T3, which is greater than the diameter D3 of the portion of the corresponding shaft 3, 4 received in the lower accommodating portion 11*a*. This allows each shaft 3, 4 to be inserted into the corresponding lower accommodating portion 11*a* from above the lower housing member 10, despite the fact that the lower support portions 13, 17 have the structures that prevent lifting of the bearing holders 26 and the front bearings 30, 31. As a result, the shafts 3, 4 are easily attached to the lower housing member 10.

(7) The annular shaft seal 61 and the slinger 66, which have diameters greater than the diameter of each rear bearing 32, 33, are attached forward from the portion of each shaft 3, 4 supported by the rear bearing 32, 33. The annular shaft seal 61 and the slinger 66 are received in the corresponding rear lower seal accommodating portion 12 through the associated lower support portion 13 from behind the lower housing member 10. For this purpose, each lower support portion 13 is sized in such a manner that the lower support portion 13 is capable of passing through the annular shaft seal 61 and the slinger 66, and thus has a diameter greater than the diameter of each rear bearing 32, 33. As a result, when the housing 2 is assembled, a gap is formed between the inner circumferential surface of each rear bearing accommodating portion 82 and the outer circumferential surface of the associated rear bearing 32, 33. In the present embodiment, the bearing holders 26 are employed to fix the rear bearings 32, 33 to the lower housing member 10. The gaps are thus sealed by the bearing holders 26. As a result, the annular shaft seals 61 suppress leakage of fluid along the circumferential surfaces of the shafts 3, 4, while the spiral grooves 63 of the annular shaft seals 61 and the slingers 66 prevent lubricant oil from entering the pump chamber 74. Further, the bearing holders 26 prevent the rear bearings 32, 33 from lifting.

(8) Each annular shaft seal 61, which is received in the corresponding rear seal accommodating portion 80, has a diameter greater than the outer diameter of each rear bearing 32, 33 supported by the corresponding rear bearing accommodating portion 82. This increases the circumferential velocity of the spiral groove 63 formed in the outer circumferential surface of each annular shaft seal 61. The spiral groove 63 thus efficiently urges the lubricant oil to move from the pump chamber 74 toward the gear housing 5.

(9) The outer diameter of the maximum diameter portion of each slinger 66 is greater than the outer diameter of each rear bearing 32, 33. As the outer diameter of the slinger 66 becomes greater, the lubricant oil is splashed in a radially outward direction of the slinger 66 more efficiently. The lubricant oil is thus prevented from entering the pump chambers 70 to 74.

(10) The drive shaft 3, the driven shaft 4, the front bearings 30, 31, the rear bearings 32, 33, the drive rotors 40 to 44, and the driven rotors 45 to 49 are exposed from the lower joint surface 10*a* while being attached to the lower housing member 10. All of the clearances between the rotors 40 to 49 and the lower wall pieces 11 are thus visible while being measured actually. Further, all of the phase differences between the engaged pairs of the rotors 40 to 49 are visible.

(11) The entire portion of the lower joint surface 10*a*, which contacts the upper housing member 20, is located on a common plane. This makes it unnecessary to form a step in the lower joint surface 10*a* of the lower housing member 10. This facilitates manufacture of the housing 2.

(12) If, for example, the lower joint surface 10*a* has a step, the upper joint surface 20*a* is joined to the lower joint surface 10*a* after a step corresponding to the step of the lower joint surface 10*a* is formed in the upper joint surface 20*a*. If there is a tolerance of dimensions between the lower joint surface 10*a* and the upper joint surface 20*a*, it is highly likely that a gap is formed in the joint portion 50 between the lower joint surface 10*a* and the upper joint surface 20*a*. This may decrease the sealing performance of the joint portion 50. However, since the lower joint surface 10*a* of the first embodiment is a flat surface as a whole, the upper joint surface 20*a* is flush with the lower joint surface 10*a* when contacting the lower joint surface 10*a*. This improves the sealing performance of the joint portion 50.

A second embodiment of the present invention will hereafter be described with reference to FIGS. 7 and 8. The second embodiment, which will be explained in the following, is different from the first embodiment in the bearing positioning structure. Like or the same reference numerals are given to those components that are like or the same as the corresponding components of the first embodiment, and detailed explanations are omitted.

Figure 7:
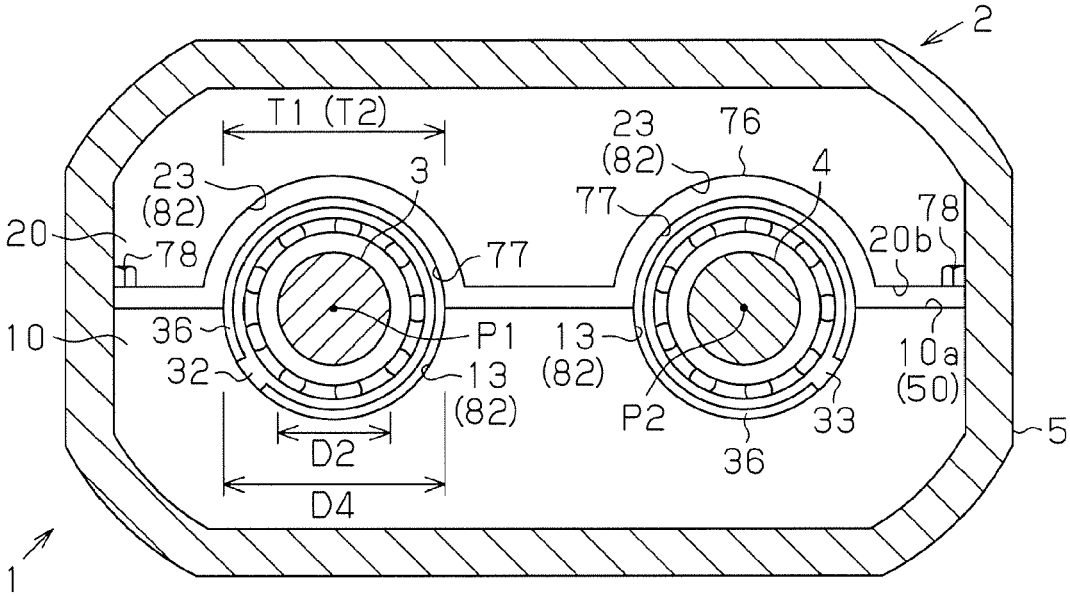
FIG. 7 is a cross-sectional view showing a rear bearing accommodating portion according to a second embodiment of the present invention.
Figure 8:
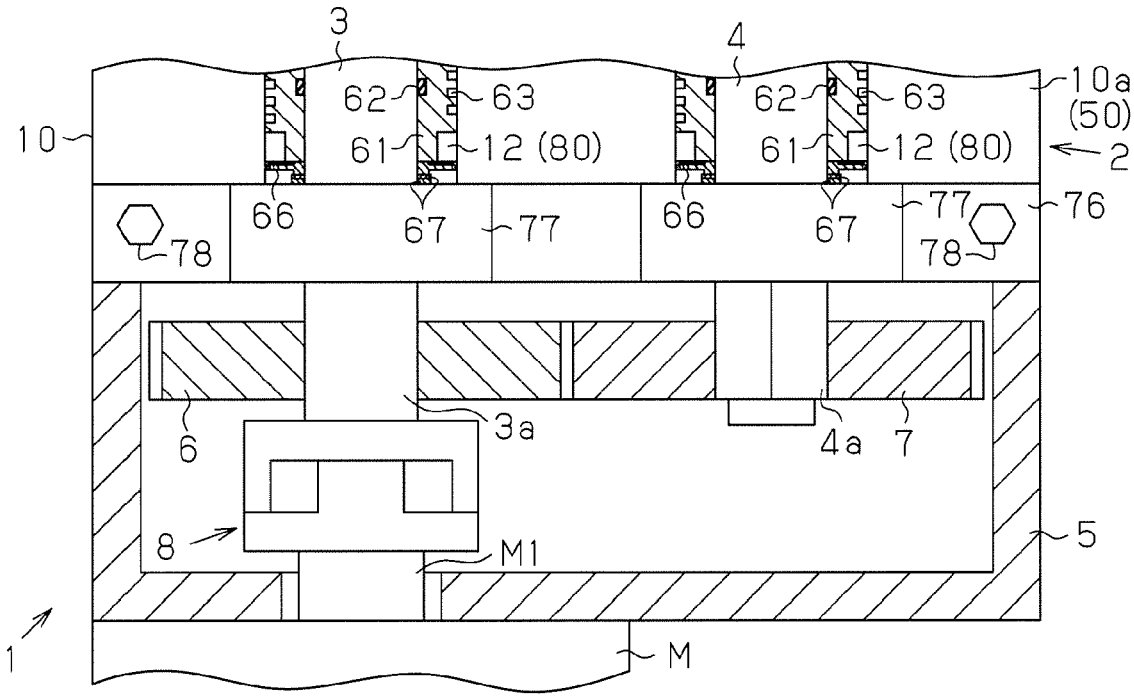
FIG. 8 is a cross-sectional plan view showing the rear bearing accommodating portion illustrated in FIG. 7.

As illustrated in FIG. 7, the joint portion 50 of the housing 2 is located at the height equal to the axes P1, P2 of the shafts 3, 4. In other words, the housing 2 has a two part structure including the lower housing member 10 and the upper housing member 20.

The diameter of each rear bearing accommodating portion 82 and the diameter of each rear seal accommodating portion 80 are each smaller than the corresponding diameter of the first embodiment. The diameter of each annular shaft seal 61 and the diameter of each slinger 66, which are received in the corresponding rear seal accommodating portion 80, are each smaller than the corresponding diameter of the first embodiment. In the second embodiment, the rear bearings 32, 33 are received in the corresponding rear bearing accommodating portions 82 and directly supported by the rear bearing accommodating portions 82. The rear bearings 32, 33 are fixed to the lower housing member 10 by a bearing band 76 serving as a bearing positioning member.

The bearing band 76 is formed of the common metal material with the lower housing member 10 and has an elongated plate-like shape. Two bearing holding portions 77 are formed in the bearing band 76 in arcuately bent shapes to extend along the outer circumferences of the rear bearings 32, 33. The portions of the bearing band 76 other than the bearing holding portions 77 form a flat plate-like shape. The bearing band 76 is fixed to the lower joint surface 10*a* through bolts 78. When the bearing band 76 is fixed to the lower joint surface 10*a*, the inner circumferential surface of each one of the bearing holding portions 77 is arranged continuously from the inner circumferential surface of the corresponding one of the lower support portions 13. The inner circumferential surface of each bearing holding portion 77 and the inner circumferential surface of the corresponding lower support portion 13 thus forms a circular hole. In other words, each rear bearing 32, 33 is held by the corresponding rear bearing accommodating portion 82 configured by the inner circumferential surface of the bearing holding portion 77 and the inner circumferential surface of the corresponding lower support portion 13.

An accommodating recess 20*b*, which accommodates the bearing band 76, is formed in the portion of the upper housing member 20 facing the bearing band 76, which is fixed to the lower joint surface 10*a*, in a recessed manner. Upper support portions 23 are formed in the wall portions of the accommodating recess 20*b* corresponding to the bearing holding portions 77. As a result, with the upper housing member 20 assembled to the lower housing member 10, the portions of the upper joint surface 20*a* other than the accommodating recesses 20*b* are held in contact with the lower joint surface 10*a*.

A method for assembling the Roots pump 1 according to the second embodiment will now be explained.

First, the shafts 3, 4 are received in the lower accommodating portions 11*a* through the shaft inserting portions 111*c*, as in the first embodiment. Then, in the front portion of the housing 2, the annular shaft seals 68 are received in the front lower seal accommodating portions 18 and the annular shaft seals 68 are fixed to the corresponding shafts 3, 4. The front bearings 30, 31 are also received in the corresponding front lower support portions 17 and the front bearings 30, 31 are fixed to the corresponding shafts 3, 4 using the positioning bolts 38 and the positioning plate 39.

Subsequently, the annular shaft seals 61, the slingers 66, and the shims 67 are attached to the corresponding shafts 3, 4 in the rear seal accommodating portions 12 along the axes P1, P2. The rear bearings 32, 33 are then each received in the corresponding lower support portion 13 from behind the lower housing member 10 and secured to the corresponding one of the drive shaft 3 and the driven shaft 4.

Next, the bearing band 76 is secured to the lower joint surface 10*a* in such a manner that the inner circumferential surfaces of the bearing holding portions 77 extend along the outer circumferential surfaces of the rear bearings 32, 33 projecting from the lower joint surface 10*a*. By this time, the snap rings 36 have been secured to the bearing band 76 in advance. The bolts 78 are then passed through the bearing band 76 in such a manner that the bolts 78 are threaded to the lower joint surface 10*a*. This causes the bearing band 76 to position the rear bearings 32, 33 in states in which the rear bearings 32, 33 are prevented from separating from the lower support portions 13.

Then, as in the first embodiment, the clearances between the rotors 40 to 49 and the corresponding lower wall pieces 11 are measured. If the measured clearances are not appropriate, the bolts 78 are removed from the lower joint surface 10*a*, and the bearing band 76 and the rear bearings 32, 33 are removed from the lower support portions 13. The thickness or the number of the shims 67 is then adjusted in such a manner that appropriate clearances are obtained. Afterwards, the rear bearings 32, 33 are secured to the drive shaft 3 and the driven shaft 4 and the bearing band 76 is fixed to the lower joint surface 10*a*.

Subsequently, the phase differences of the rotors 40 to 49 are adjusted. Then, the drive gear 6 and the driven gear 7 are secured to the end 3*a* of the drive shaft 3 and the end 4*a* of the driven shaft 4, which are arranged in parallel with each other, respectively, in such a manner that the drive gear 6 and the driven gear 7 become engaged with each other. Similar steps to those of the first embodiment follow so that the Roots pump 1 is assembled completely.

The second embodiment has the following advantage in addition to the advantages equivalent to the advantages (1), (4) to (6), and (10) to (12) of the first embodiment.

(13) To prevent lifting of the rear bearings 32, 33, the bearing band 76 is fixed to the lower joint surface 10*a*. The bearing band 76 is installed simply by fixing the bearing band 76 to the lower joint surface 10*a* with the bolts 78. As a result, the structure that prevents lifting of the rear bearings 32, 33 and positions the rear bearings 32, 33 in the lower support portions 13 is easily provided.

The illustrated embodiments may be modified as follows.

In the first embodiment, the bearing holders 26 may be fixed to the front bearing accommodating portions 81, which are arranged in the front portion of the housing 2. In this case, the bearing holders 26 position the front bearings 30, 31 with respect to the lower housing member 10.

In the first embodiment, the front bearings 30, 31, which are provided in the front portion of the housing 2, may be positioned by the bearing band 76 with respect to the lower housing member 10.

In the second embodiment, the front bearings 30, 31, which are formed in the front portion of the housing 2, may be positioned by the bearing band 76 with respect to the lower housing member 10.

In the second embodiment, the front bearing accommodating portions 81, which are arranged in the front portion of the housing 2, may receive the bearing holders 26 that hold the front bearings 30, 31. Further, the bearing holders 26 may be fixed to the lower housing member 10 so that the bearing holders 26 position the front bearings 30, 31 with respect to the lower housing member 10.

In the first embodiment, the snap rings 36 may be omitted as long as rearward movement of the rear bearings 32, 33, which are fitted in the bearing holders 26, is restricted through such arrangement of the rear bearings 32, 33.

In the second embodiment, the snap rings 36 may be omitted as long as rearward movement of the rear bearings 32, 33 is restricted by positioning the rear bearings 32, 33 using the bearing band 76.

In the first embodiment, the uppermost portions of the lower support portions 13, 17 (the lower joint surface 10*a*) may be located either at the height equal to or below the axes P1, P2 of the shafts 3, 4.

In the second embodiment, the uppermost portions of the lower support portions 13, 17 (the lower joint surface 10*a*) may be located above the axes P1, P2 of the shafts 3, 4.

The fixing members with which the bearing holders 26 are fixed to the lower housing member 10 may be screws, instead of the bolts 29.

The flange portion 28 of each bearing holder 26 may have a circular shape. Alternatively, the flange portion 28 may have a projecting shape in which the through holes 28*a* are formed, without extending over the entire circumference of the associated holder body 27.

In the first embodiment, each bearing holder 26 may be fixed to both the lower housing member 10 and the upper housing member 20.

The sizes and the shapes of the pump chambers 70 to 74 may be changed in accordance with the sizes and the shapes of the rotors 40 to 49.

The present invention may be embodied as a fluid machine other than the Roots pump 1, as long as the fluid machine transports fluid through rotation of the rotors 40 to 49, each of which is arranged on the corresponding one of the drive shaft 3 and the driven shaft 4. For example, the invention may be embodied as a screw pump or a claw pump.

The housing 2 may support a single rotary shaft.

The number of the pump chambers formed in the housing 2 may be changed to, for example, more than four or only one.

The invention claimed is:

1. A root pump comprising a rotary shaft, a housing supporting the rotary shaft through a bearing, and a rotor rotatable integrally with the rotary shaft, the root pump transporting fluid through rotation of the rotor together with the rotary shaft, wherein the housing is a two-piece structure comprising a lower housing member and an upper housing member, wherein the lower housing member includes a lower accommodating portion that has an upward opening so as to receive a lower portion of the bearing and the upper housing member includes an upper accommodating portion that has a downward opening so as to accommodate an upper portion of the bearing, wherein, with the upper and lower housing members joined together, the upper and lower accommodating portions form a bearing accommodating portion that accommodates the entire bearing, and wherein the root pump includes a positioning member that is attached to the bearing and fixed to the lower housing member in such a manner that the bearing is accommodated in the lower accommodating portion in a positioned state.

2. The root pump according to claim 1, wherein the positioning member is a bearing holder having a cylindrical holder body received in the lower accommodating portion and a flange portion that is formed integrally with the holder body and extends radially outward from an axial end of the holder body, the bearing being received in the holder body in such a manner that the entire outer circumference of the bearing is covered by the holder body, wherein the flange portion has a through hole, through which a fixing member fixing the bearing holder to the lower housing member is passed, and wherein the holder body is arranged between an inner circumferential surface of the bearing accommodating portion and an outer circumferential surface of the bearing that faces the inner circumferential surface of the bearing accommodating portion.

3. The root pump according to claim 2, wherein an uppermost portion of the lower accommodating portion is located above the axis of the bearing holder received in the lower accommodating portion, and wherein an opening width of the lower accommodating portion is smaller than an outer diameter of the bearing holder.

4. The root pump according to claim 1, wherein an upper surface of the lower housing member forms a lower joint surface joined to the upper housing member, and wherein the positioning member is a bearing band that covers an outer circumferential surface of a portion of the bearing protruding upward from the lower joint surface and is fixed to the lower joint surface.

5. The root pump according to claim 1, wherein the rotary shaft is one of a plurality of rotary shafts that are arranged in parallel, wherein rotors of each adjacent pair of the rotary shafts are engageable with each other, wherein a gear is secured to each rotary shaft, and wherein the gears are mutually engaged in such a manner that the rotary shafts are synchronously rotatable and that a phase difference between each engaged pair of the rotors is determined.

* * * * *